US006837140B2

(12) United States Patent
Oka et al.

(10) Patent No.: US 6,837,140 B2
(45) Date of Patent: Jan. 4, 2005

(54) CONTROL SYSTEM AND METHOD FOR HYDRAULIC WORKING MACHINE

(75) Inventors: Hidekazu Oka, Hiroshima (JP); Kazuhiko Fujii, Hiroshima (JP); Naoki Sugano, Kobe (JP); Etsujiro Imanishi, Kobe (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 60 days.

(21) Appl. No.: 10/356,586

(22) Filed: Feb. 3, 2003

(65) Prior Publication Data

US 2003/0145721 A1 Aug. 7, 2003

(30) Foreign Application Priority Data

Feb. 4, 2002 (JP) ..... 2002-026413

(51) Int. Cl.[7] ..... F15B 13/04
(52) U.S. Cl. ..... 91/436; 91/33; 91/444
(58) Field of Search ..... 91/DIG. 2, 436, 91/440, 444, 32, 33

(56) References Cited

U.S. PATENT DOCUMENTS

| | | | |
|---|---|---|---|
| 4,505,111 | A | 3/1985 | Okamoto et al. |
| 5,513,551 | A | 5/1996 | Morishita |
| 5,941,155 | A | 8/1999 | Arai et al. |

FOREIGN PATENT DOCUMENTS

| | | |
|---|---|---|
| JP | 10-18356 | 1/1998 |
| JP | 10-147959 | 6/1998 |
| JP | 10-306468 | 11/1998 |
| JP | 11-13702 | 1/1999 |
| JP | 11-13703 | 1/1999 |
| JP | 11-30204 | 2/1999 |
| JP | 11-222384 | 8/1999 |
| JP | 11-311201 | 11/1999 |
| JP | 2000-18208 | 1/2000 |
| JP | 2000-18209 | 1/2000 |
| JP | 2000-240604 | 9/2000 |
| JP | 2001-99106 | 4/2001 |

*Primary Examiner*—Edward K. Look
*Assistant Examiner*—Michael Leslie
(74) *Attorney, Agent, or Firm*—Oblon, Spivak, McClelland, Maier & Neustadt, P.C.

(57) ABSTRACT

The present invention relates to a control system and method for a hydraulic working machine characterized by having a construction wherein a flow discharge control valve is disposed in a discharge-side pipe line of a main flow control valve, the amount of operation of an operating lever is converted to a pilot pressure by a remote controlled valve, the pilot pressure is then input to a controller and is calculated into a pressure change speed as operation speed, in a pressure change speed calculator, further, the operation speed is calculated into an electromagnetic valve current in an electromagnetic valve current calculator, then the electromagnetic proportional valve current is output to an electromagnetic proportional valve from a command unit, and the degree of opening of the discharge flow control valve is controlled with a secondary pressure in the electromagnetic proportional valve. According to this construction, it is possible to diminish impact and vibration which occur when there is performed a sudden operation, and also possible to improve the operability for braking and stopping an actuator.

6 Claims, 7 Drawing Sheets

CONTROL SYSTEM AND METHOD FOR HYDRAULIC WORKING MACHINE

BACKGROUND OF THE INVENTION

1. Field of the Invention

The present invention relates to a control system and method for a hydraulic working machine which performs works by driving an actuator with use of hydraulic fluid.

2. Description of the Related Art

If an operating lever for controlling an actuator speed in a hydraulic working machine is operated suddenly, the actuator speed will change suddenly, causing a violent impact or vibration. In an effort to solve this problem, there has been proposed a technique in which a throttle is inserted in a pilot line for controlling a main flow control valve to delay the response of the flow control valve relative to a lever operation. With this technique, however, the follow-up performance of the actuator speed relative to a lever operation is deteriorated and so is the operability. As a countermeasure there is known a technique in which a variable throttle is used as the throttle inserted in the pilot line for the flow control valve or a pipe is provided for communication between both side pipes which connect the actuator and the control valve with each other.

However, in the former case, if the variable throttle should fail, the motion of the control valve is deteriorated, causing problems in operation such as the actuator becoming difficult to be braked. Also in the latter case, the front and rear of the actuator become communicated, giving rise to problems in operation such as the actuator no longer coming to a stop. Further, since a bypass passage for communication between both side pipes is formed, the amount of hydraulic fluid fed to the actuator decreases and so does the speed.

SUMMARY OF THE INVENTION

It is an object of the present invention to provide a control system and method for a hydraulic working machine capable of diminishing impact and vibration generated when an operating lever for example is operated suddenly and also capable of improving the braking and stopping operability or operationality for the actuator.

The control system for a hydraulic working machine according to the present invention comprises a hydraulic pump; a hydraulic actuator adapted to be actuated with a driving medium discharged from the hydraulic pump; a switching means adapted to control the supply and discharge of the driving medium to and from the hydraulic actuator; an operating means adapted to operate the switching means; a discharge flow control means located in a discharge-side pipe line of the switching means to control the discharge flow rate of the driving medium; and a controller adapted to detect an operation speed of the operating means and operate the discharge flow control means in accordance with the operation speed detected.

According to this construction, since the discharge flow rate in the discharge-side pipe line of the hydraulic actuator is controlled in accordance with the operation speed, it is possible to diminish impact or vibration which occurs when a sudden operation is performed for the operating means. Besides, since the discharge flow control means is installed in the discharge-side pipe line of the switching means, even in the event the discharge flow control means should fail, it becomes possible to effect braking and stopping of the hydraulic actuator by operating the switching means, and further the operability is also improved.

DESCRIPTION OF THE PREFERRED EMBODIMENTS

Control systems for a hydraulic working machine embodying the present invention will be described hereinunder with reference to the accompanying drawings. The following embodiments describe the example to a control system applied to the boom cylinder circuit of the hydraulic excavator. It is to be understood that the invention is not limited to the following embodiments.

First Embodiment

A first embodiment of the present invention will be described below with reference to FIGS. 1 to 8.

Figure 1:
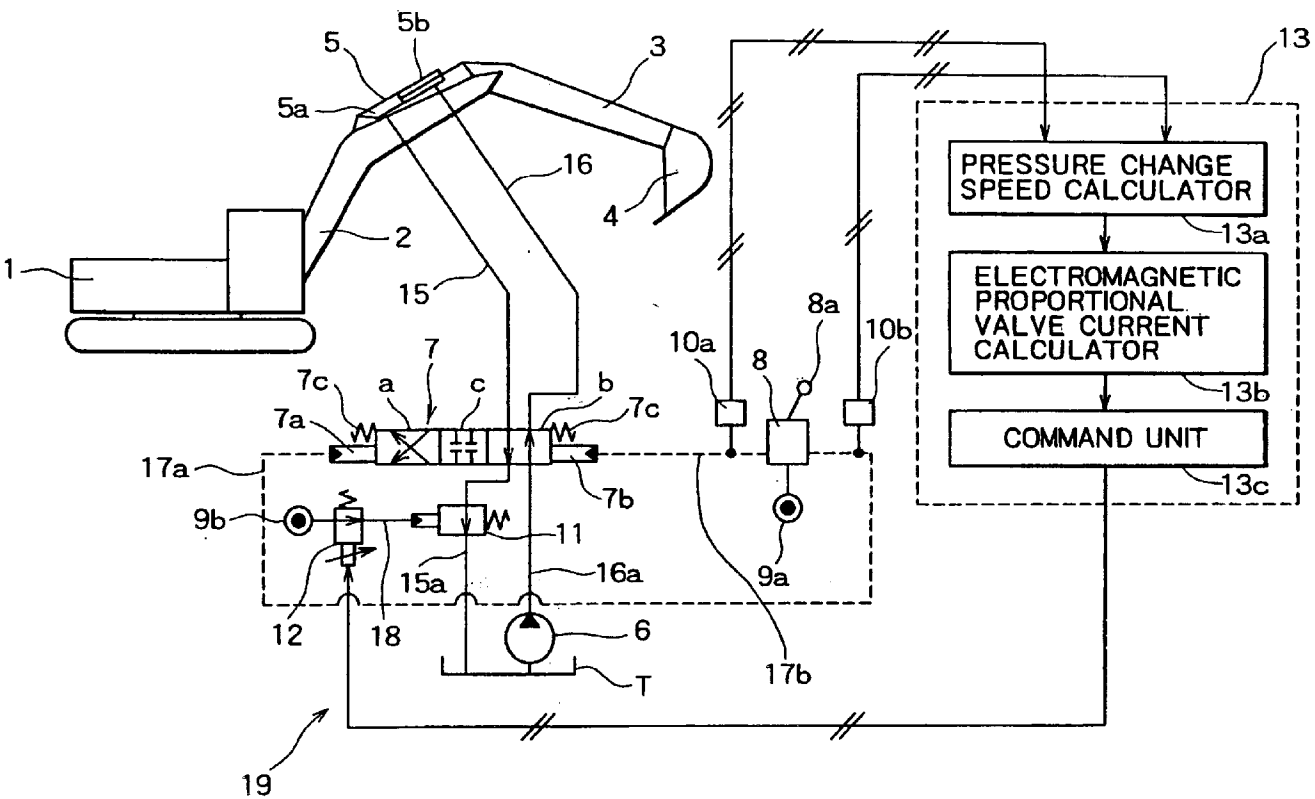
FIG. 1 is a circuit diagram of principal portions of a control system for a hydraulic working machine according to a first embodiment of the present invention.

FIG. 1 is a circuit diagram of principal portions of a control system for a hydraulic working machine according to a first embodiment of the present invention. A hydraulic excavator 1 shown in FIG. 1 is a kind of a hydraulic working machine adapted to perform works, e.g., excavation, with use of an oil pressure. The hydraulic excavator 1 is provided with a boom 2, an arm 3, and a bucket 4. A hydraulic cylinder 5 as an actuator is mounted between the boom 2 and the arm 3. The arm 3 is actuated by expansion and contraction of the hydraulic cylinder 5.

As shown in FIG. 1, a control system 19 for the hydraulic excavator 1 is made up of the hydraulic cylinder 5 as a hydraulic actuator, a pump 6 as a hydraulic pump, a main flow control valve 7 as a switching means, a remote controlled valve 8 as an operating means, pressure sensors 10*a* and 10*b* as pilot pressure sensors, a discharge flow control valve 11 as a discharge flow rate control means, an electromagnetic proportional valve 12, and a controller 13 as a control means.

The pump 6 supplies pressure oil from a tank T to the hydraulic cylinder 5. A first pipe line 15 connected to a head-side oil chamber 5*a* in the hydraulic cylinder 5 and a second pipe line 16 connected to rod-side oil chamber 5*b* in the hydraulic cylinder 5 are connected to each other through a hydraulic pilot switching type main flow control valve 7. The main flow control valve 7 is connected to the pump 6 through a feed-side pipe 16*a* and is also connected to the tank T through a discharge-side pipe 15*a*.

The main flow control valve 7 is a hydraulic pilot switching type valve and serves as a pilot switching valve. The main flow control valve 7 controls an operating direction and flow rate of hydraulic oil fed and discharged to and from the hydraulic cylinder 5. The main flow control valve 7 has the following three switching positions—a first position, a, in which the valve is switched by the supply of pilot pressure to a pilot port 7*a*, a second position, b, in which the valve is switched by the supply of pilot pressure to a pilot port 7*b*, and a neutral position, c, in which the valve is switched by pushing with a spring 7*c*. In the first position a, the hydraulic cylinder 5 expands, while, in the second position b, the hydraulic cylinder 5 contracts.

The remote controlled valve 8 is operated by an operating lever 8*a*. The remote controlled valve 8 is an operating means which converts the amount of operation of the operating lever 8*a* into a pilot pressure. When the remote controlled valve 8 is operated, the pilot pressure is fed to the operated one of the pilot ports 7*a* and 7*b* located on both sides of the main flow control valve 7 through a pilot line 17*a* or 17*b*, whereby the main flow control valve 7 performs a switching operation. The remote controlled valve 8 has a pressure source 9*a*.

Pressure sensors 10*a* and 10*b* are connected respectively to both-side pilot lines 17*a* and 17*b*. The pressure sensors 10*a* and 10*b* are each adapted to detect a pilot pressure Pi which corresponds to the amount of operation of the remote controlled valve 8. A pilot pressure signal is input to the controller 13 upon detection of the pilot pressure Pi.

The discharge flow control valve 11, which acts as a discharge flow control means, is located in a discharge-side pipe line 15*a* of the main flow control valve 7.

In the electromagnetic proportional valve 12, a secondary pressure 18 thereof is controlled in accordance with a command signal provided from the controller 13 and opening or the degree of opening of the discharge flow control valve 11 is controlled in accordance with the secondary pressure 18 of the electromagnetic proportional valve. The electromagnetic proportional valve 12 has a pressure source 9*b*.

The controller 13 is a control means and is made up of a pressure change speed calculator 13*a* as pressure change speed calculating means, an electromagnetic proportional valve current calculator 13*b* as a calculating means for calculating a current applied to an electromagnetic proportional valve, and a command unit 13*c* as a command means. The pressure change speed calculator 13*a* calculates a pilot pressure change speed, i.e., operation speed, of the pilot pressure Pi on the basis of the pilot pressure signal inputted from the pressure sensor 10*a* or 10*b*. The electromagnetic proportional valve current calculator 13*b* calculates a current for the electromagnetic proportional valve on the basis of the thus-calculated operation speed. There are some cases that the same current, hereinafter, is described as the electromagnetic proportional valve current. The command unit 13*c* outputs the thus-calculated electromagnetic proportional valve current to the electromagnetic proportional valve 12.

Figure 2:
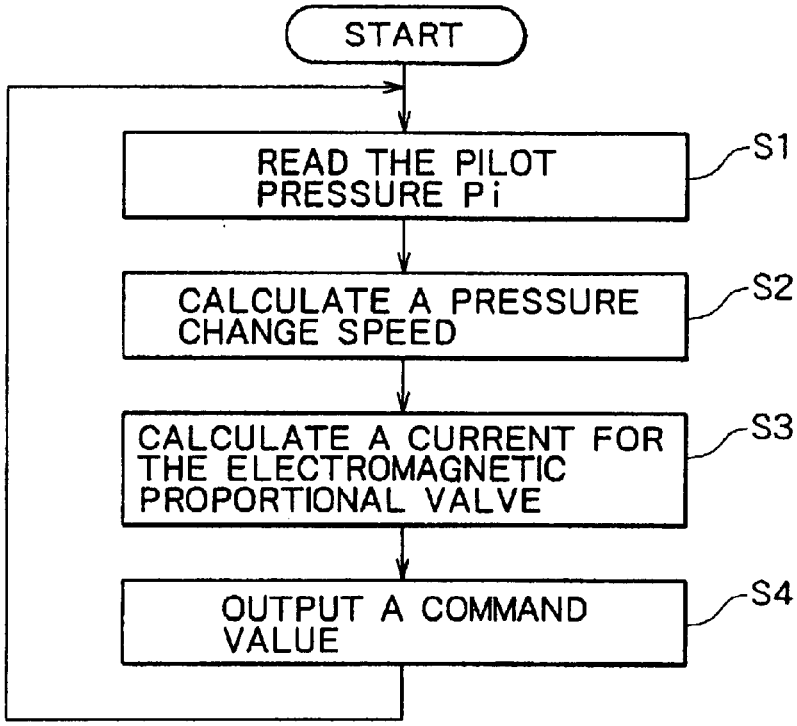
FIG. 2 is a flow chart showing a control method for the hydraulic working machine according to the first embodiment.

Next, the operation of the control system 19 for the hydraulic excavator 1 will be described. FIG. 2 is a flow chart showing a control method for the hydraulic working machine according to this embodiment.

Figure 3:
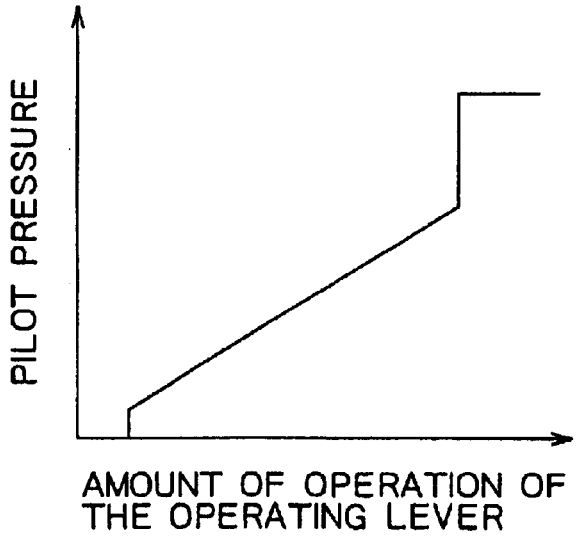
FIG. 3 is a diagram showing a relation between the amount of operation of an operating lever and a pilot pressure.

First, when the operating lever 8*a* is operated, the amount of the operation is converted to a pilot pressure. The pilot pressure is detected by the pressure sensor 10*a* or 10*b* and is inputted to the controller 13. In the controller 13, the pilot pressure Pi is read out from the pilot signal inputted by the pressure sensor 10*a* or 10*b* (step S1). The amount of operation of the operating lever and the pilot pressure bear such a relation as shown in FIG. 3.

Then, in the pressure change speed calculator 13*a*, a pressure change speed, i.e., operation speed, is determined on the basis of both a present value Pi(T) of the read pilot pressure and the pilot pressure Pi(T−T) which was inputted on the last-time sampling occasion (step S2). The operation speed dPi/dt is determined in accordance with the following equation:

$$dPi/dt=(Pi(T)-Pi(T-T))/T$$

Figure 4:
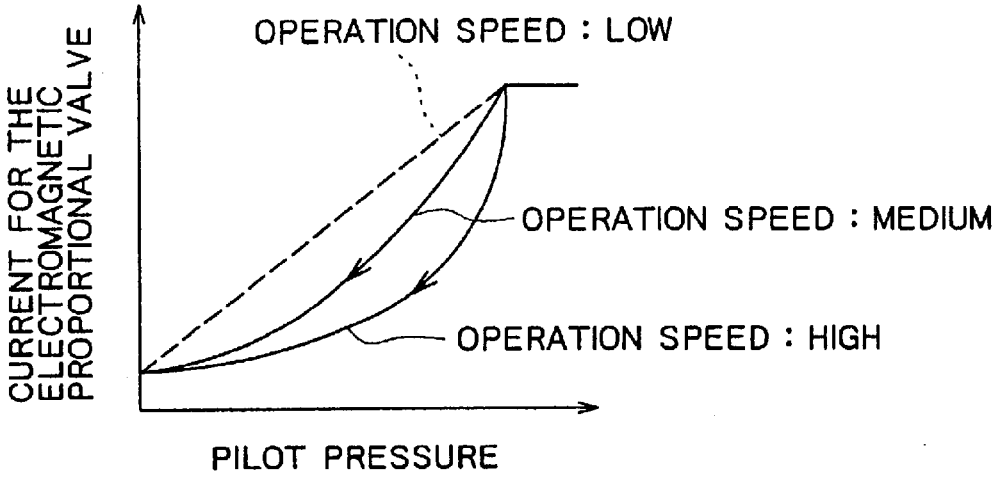
FIG. 4 is a diagram showing a relation between a pilot pressure and an electric current applied to an electromagnetic proportional valve.

The operation speed thus calculated is inputted to the electromagnetic proportional valve calculator 13*b*, in which an electromagnetic proportional valve current is calculated in accordance with the map of FIG. 4 which illustrates a relation between the pilot pressure and the electromagnetic proportional valve current (step S3). In calculating an electromagnetic proportional valve current, there are used different maps according to operation speeds, as shown in FIG. 4. The maps are set so that the current for the electromagnetic proportional valve is smaller on a higher side of the operation speed.

The electromagnetic proportional valve current thus calculated is outputted or applied to the electromagnetic proportional valve 12 by the command unit 13*c* (step S4).

Figure 5:
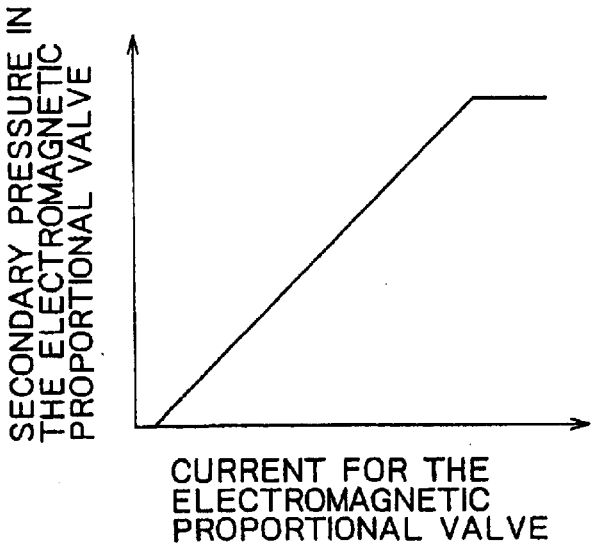
FIG. 5 is a diagram showing a relation between an electric current applied to the electromagnetic proportional valve and a secondary pressure in the same valve.

In the electromagnetic proportional valve 12, the secondary pressure 18 in the same valve is controlled with the electromagnetic proportional valve current thus outputted. As shown in FIG. 5, the current and secondary pressure in the electromagnetic proportional valve are directly proportional to each other. As the current for the electromagnetic proportional valve increases, the secondary pressure thereof also increases.

Figure 6:
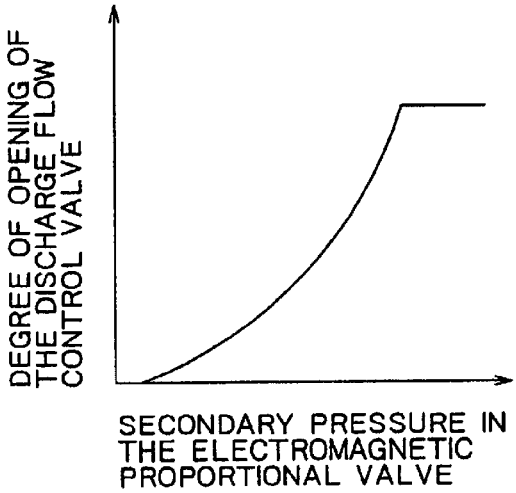
FIG. 6 is a diagram showing a relation between a secondary pressure in the electromagnetic proportional valve and the degree of opening of a discharge flow control valve.

Further, the degree of opening of the discharge flow control valve 11 is controlled with the secondary pressure 18 in the electromagnetic proportional valve. As shown in FIG. 6, the secondary pressure in the electromagnetic proportional valve and the degree of opening of the discharge flow control valve are nearly proportional to each other. As the current for the electromagnetic proportional valve increases, the degree of opening of the discharge flow control valve also increases.

Figure 7:
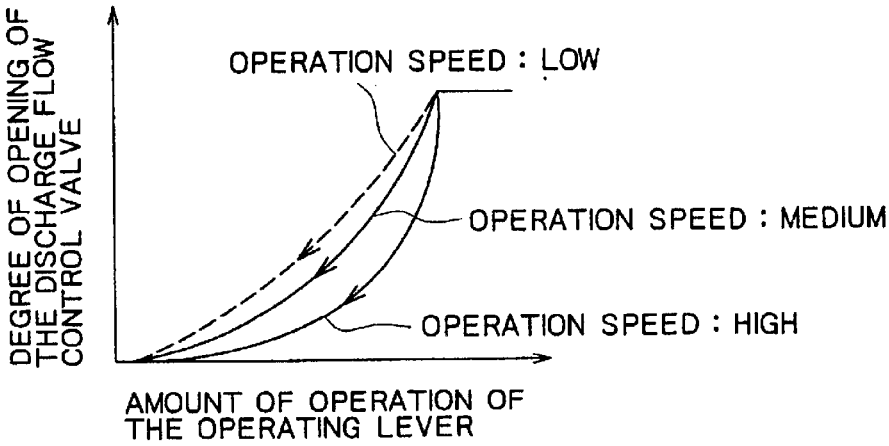
FIG. 7 is a diagram showing a relation between the amount of operation of the operating lever and the degree of opening of the discharge flow control valve.

According to the control system 19, when the amount of operation is large and the operation speed is high, the degree of opening of the discharge flow control valve 11, which is installed in the discharge-side pipe line 15*a* in series with the main flow control valve 7, becomes smaller as the operation speed increases, as shown in FIG. 7. Accordingly, the discharge flow control valve 11 is throttled, so that a sufficient back pressure is developed in the hydraulic cylinder 5 from just after the start of lever return, as shown in FIG. 8.

On the other hand, when braking is to be applied to an actuator in a conventional hydraulic drive circuit, a back pressure is developed in a discharge-side pipe line of the actuator by returning an operating lever. As a result, a braking force is generated to decelerate and stop the actuator. There is used such a meter-out control. In this case, a back pressure is generated with a throttle provided on a discharge side of a main control valve. Generally, with throttling of the main control valve discharge-side throttle, the heat of generation caused by pressure loss, i.e., the amount of energy loss, becomes large in the throttle portion in a normal operation mode. If the throttle portion is throttled too much, the fuel consumption efficiency will be deteriorated. Therefore, in the case of the prior art shown in FIG. 8, if there is performed a sudden operation for lever return, there is not obtained a sufficient back pressure at the beginning of lever return, with consequent deficiency of the braking force. This is because the throttle on the main control valve discharge-side throttle is not fully throttled.

Figure 8:
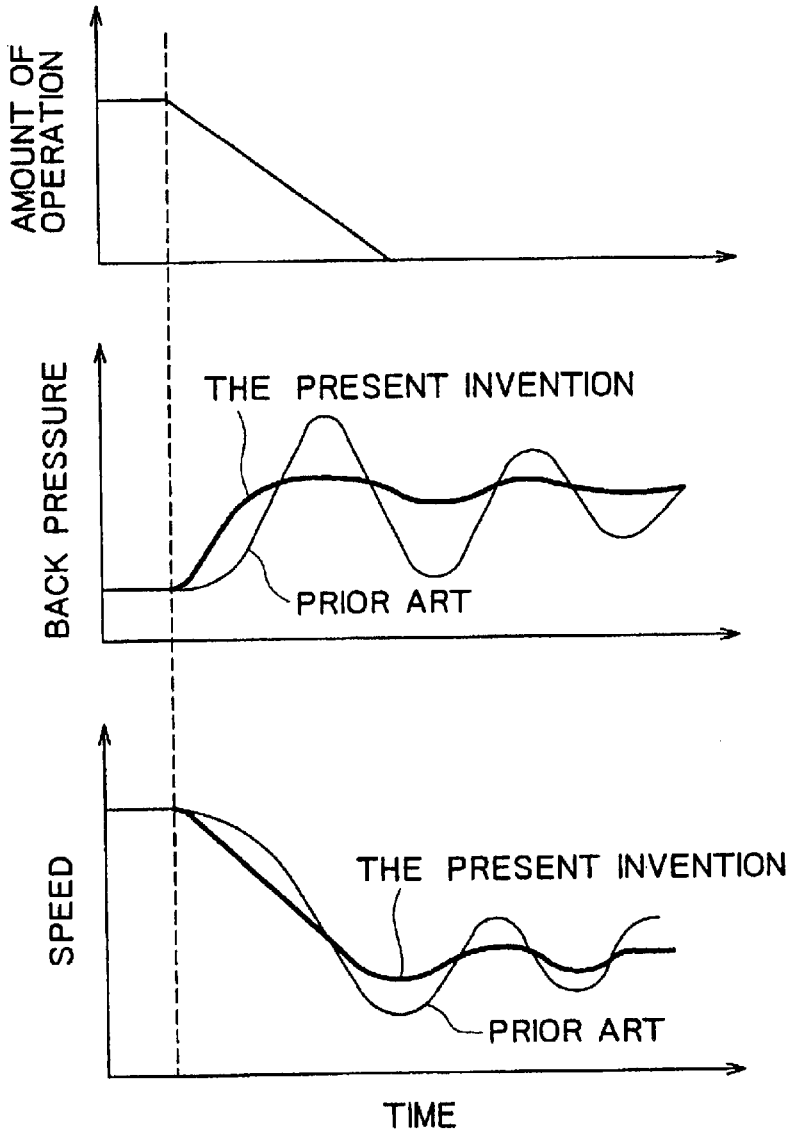
FIG. 8 is a diagram showing states of change in the amount of operation, back pressure, and speed in the first embodiment of the invention and those in the prior art.

On the other hand, according to the present invention, as shown in FIG. 8, a sufficient braking force is generated to decrease the actuator speed in an early stage of lever return as compared with the prior art. Thus, just before stop of the actuator there is a sufficient deceleration of the actuator speed, so it is possible to solve the problem of a high back pressure being developed to apply a sudden braking as in the prior art. That is, it is possible to diminish impact and vibration which occur upon sudden return of the operating lever.

More particularly, as the operation speed increases, the discharge flow rate on the discharge-side pipe line is decreased by adjusting the degree of opening of the discharge flow control means, which is done by the control system 19, so that when a sudden operation is performed for the operating means, a sufficient back pressure (braking force) is developed to decrease the actuator speed in an early stage just after the operation. Thus, it is possible to diminish impact and vibration which occur when the sudden operation is performed.

According to the control system 19 constructed as above, with such a lever operation as is relatively low in the operation speed, the throttle of the discharge-side flow control valve is not throttled strongly, as shown in FIG. 7. Consequently, the problem of heat generation caused by pressure loss in the throttle portion becomes difficult to occur.

In this embodiment, moreover, since there is not adopted such a construction as a variable throttle using an electromagnetic valve being inserted in the pilot line of the main flow control valve 7, the operation of the main flow control valve 7 is not influenced even in the event of failure of the discharge flow control valve 11 or the electromagnetic proportional valve 12. Therefore, braking and stop can be done by the function of the main flow control valve 7, thus ensuring an excellent operability.

Further, the construction of this embodiment is different from the construction wherein a variable throttle using an electromagnetic valve and the main flow control valve are arranged in parallel with each other. In this embodiment, the discharge flow control valve 11 which is actuated by the electromagnetic proportional valve 12 is disposed or located in the discharge-side pipe line 15*a* of the main flow control valve 7. Consequently, even in the event of failure of the discharge flow control valve 11 or the electromagnetic proportional valve 12, the main flow control valve 7 is fully closed when the lever is returned to its neutral position. As a result, the first and second pipe lines 15, 16 close completely, permitting a positive stop of the actuator.

Second Embodiment

Next, a second embodiment of the present invention will be described below with reference to FIG. 9, which is a circuit diagram of principal portions of a control system for a hydraulic working machine according to the second embodiment. As to the same components as in the first embodiment, they will be identified by the same reference numerals as in the first embodiment and explanations thereof will be omitted.

Figure 9:
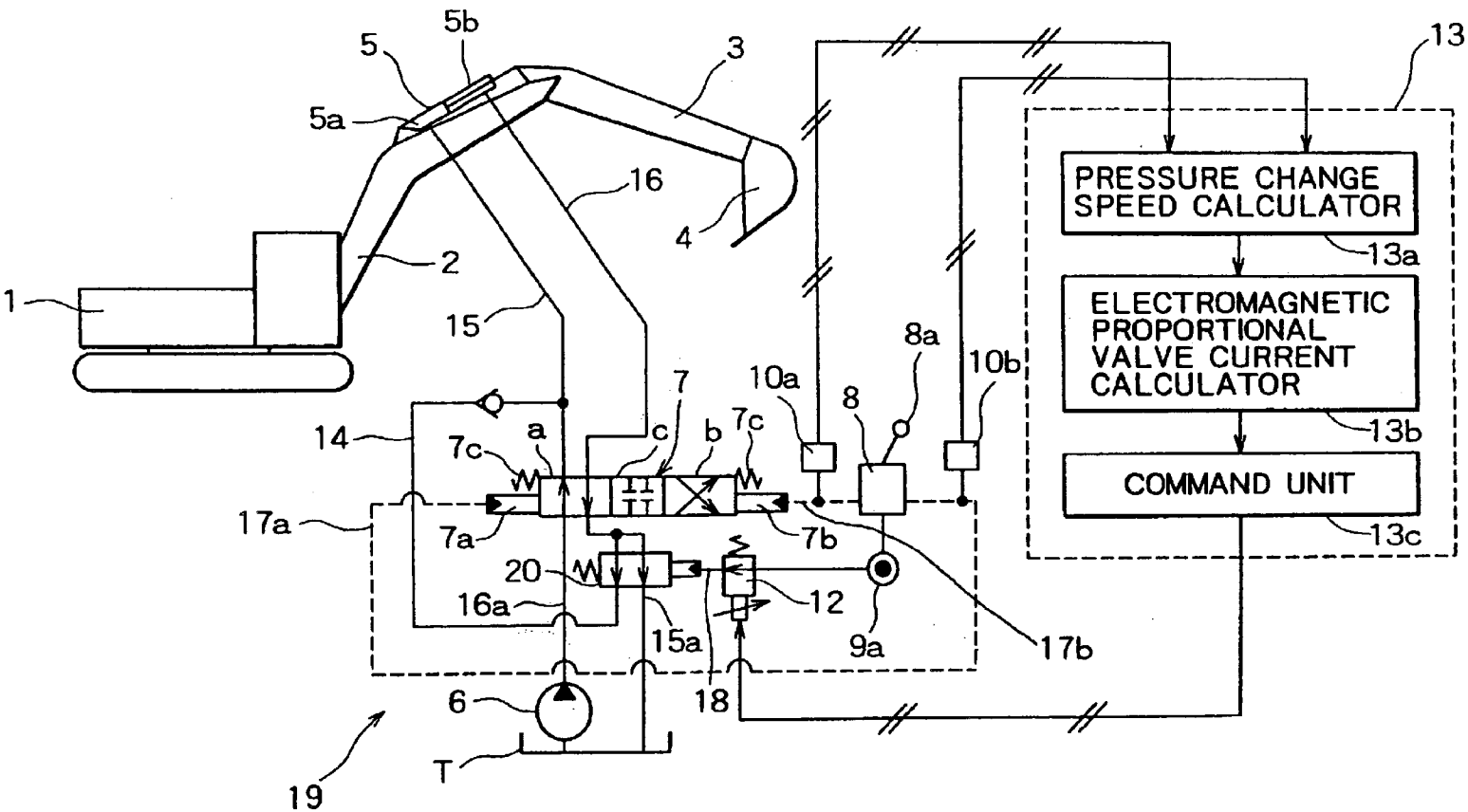
FIG. 9 is a circuit diagram of principal portions of a control system for a hydraulic working machine according to a second embodiment of the present invention.

In a control system 19 according to this second embodiment, there is provided a regenerative flow control valve 20 instead of the discharge flow control valve 11 as shown in FIG. 9. Further, a regenerative pipe line 14 is provided between a first pipe line 15 extending to a head-side oil chamber 5*a* and a discharge-side pipe line 15*a*.

The regenerative flow control valve 20 is installed in the discharge-side pipe line 15*a* in series with the main flow control valve 7 in a state of including both discharge-side pipe line 15*a* and regenerative pipe line 14. The regenerative flow control valve 20 serves as an acceleration circuit for a hydraulic cylinder 5 which acts as an actuator, and supplies a portion of pressure oil discharged from the discharge-side pipe line 15*a* to the first pipe line 15 through the regenerative pipe line 14. The remaining pressure oil is discharged to a tank T through the discharge-side pipe line 15*a*.

In an electromagnetic proportional valve 12, is controlled its secondary pressure 18 with a command signal provided from a controller 13. The degree of opening of the regenerative flow control valve 20 is controlled with the secondary pressure 18 in the electromagnetic proportional valve.

Other constructional points are the same as in the first embodiment.

In the above construction, the control system 19 of this second embodiment operates in the same way as the control system 19 of the previous first embodiment, so only different points will be described below.

When the operating lever 8*a* is operated suddenly so as to induce a descent or lowering of the arm 3, the degree of opening of the regenerative flow control valve 20 is controlled with the secondary pressure 18 in the electromagnetic proportional valve so as to become small on a higher side of the operation speed. As a result, the amount of pressure oil discharged from the discharge-side pipe line 15*a* to the tank T becomes smaller. On the other hand, as the arm 3 descends or lowers downward, the hydraulic cylinder 5 is expanded and the oil pressure in the rod-side oil chamber 5*b* becomes higher than that of the head-side oil chamber 5*a*. As a result, the flow rate from the main flow control valve 7 to the head-side oil chamber 5*a* becomes deficient. Consequently, the pressure oil discharged from the discharge-side pipe line 15*a* flows into the first pipe line 15 through the regenerative circuit 14 and is fed into the head-side oil chamber 5*a*. The secondary pressure in the electromagnetic proportional valve and the degree of opening of the regenerative flow control valve bear such a relation as shown in FIG. 6 as is the case with the previous first embodiment, provided the "DEGREE OF OPENING OF THE DISCHARGE FLOW CONTROL VALVE" in FIG. 6 corresponds to the "degree of opening of the regenerative flow control valve" in this second embodiment.

Thus, according to the control system 19 of this second embodiment, when the amount of operation becomes larger so that the operation speed becomes higher, as shown in FIG. 7, the degree of opening of the regenerative flow control valve 20 becomes smaller with an increase of the operation speed as is the case with the first embodiment. Therefore, as in the first embodiment, a sufficient back pressure is developed from just after the start of lever return by throttling of the regenerative flow control valve 20, as shown in FIG. 8. Accordingly, as in the first embodiment, it is possible to diminish impact and vibration which occur when the lever is returned suddenly. In this second embodiment, "DEGREE OF OPENING OF THE DISCHARGE FLOW CONTROL VALVE" in FIG. 7 corresponds to the "degree of opening of the regenerative flow control valve."

The regenerative flow control valve 20 can not only control the flow rate of a portion of pressure oil fed to the feed-side pipe line 16*a* through the regenerative pipe 14 but also control the flow rate of the remaining pressure oil discharged from the discharge-side pipe line 15*a*. . . . Consequently, it is possible to simplify the structure of the control system 19.

As described above, the switching means has a hydraulic pilot switching type valve. The operating means has a remote controlled valve for the supply of a pilot pressure to the switching means through a pilot line. The discharge flow control means has a discharge flow control valve for controlling the discharge flow rate through the electromagnetic proportional valve. The control means is made up of a pilot pressure detecting means for detecting a pilot pressure, an operation speed calculating means for calculating a change speed of the detected pilot pressure as an operation speed, an electromagnetic proportional valve current calculating means for calculating an electromagnetic proportional valve current in accordance with the thus-calculated operation speed, and a command means which outputs the thus-calculated electromagnetic proportional valve current as a command signal to the same valve.

According to this construction, the pilot pressure after conversion by the remote controlled valve is detected by the pilot pressure detecting means, in which the pilot pressure is calculated into an operation speed. Then in the operation speed calculating means, there is calculated a current for the electromagnetic proportional valve in accordance with the operation speed. Subsequently, with a command signal of the electromagnetic proportional valve current outputted from the command means, the discharge flow control valve is operated through the electromagnetic proportional valve to control the discharge flow rate in the discharge-side pipe line of the hydraulic actuator. Thus, it is possible to diminish impact and vibration which occur when there is performed a sudden operation for the operating means. Besides, since the discharge flow control valve is disposed in series with the hydraulic pilot switching valve, even in the event of failure of the discharge flow control valve, the hydraulic actuator can be accurately braked and stopped by operating the hydraulic pilot switching means and thus the operability is improved.

According to the present invention, moreover, there is used a regenerative flow control valve having a regenerative pipe line for the supply of a driving medium discharged from the discharge-side pipe line to either a first pipe line connected to the head-side oil chamber in the hydraulic actuator or a second pipe line connected to the rod-side oil chamber in the hydraulic actuator.

According to this construction, impact and vibration which occur upon a sudden operation of the operating means can be diminished by the discharge flow control means installed in series with the switching means. Besides, even in the event of failure of the discharge flow control means, the hydraulic actuator can be accurately braked and stopped by operating the switching means. As a result, it is possible to improve the operability. Moreover, since the regenerative flow control valve is provided in the discharge flow control means, not only it is possible to improve the operability, but also both discharge flow control and regenerative flow control can be shared, thus permitting simplification of the system structure.

Further, according to the present invention, in a hydraulic working machine having a hydraulic pump, a hydraulic actuator adapted to be actuated with a driving medium discharged from the hydraulic pump, a switching means adapted to control supply and discharge of the driving medium for the hydraulic actuator, and an operating means adapted to operate the switching means, it is recommended to provide a discharge flow control means in a discharge-side pipe line of the switching means to make control so that upon operation of the hydraulic actuator the degree of opening of the flow control means becomes smaller on a higher speed side in accordance with the operation speed of the operating means.

In this case, since the discharge flow rate in a discharge-side pipe line of the hydraulic actuator is controlled in accordance with the operation speed by the discharge flow control means, it becomes possible to make control so as to diminish impact and vibration which occur when the operating lever is operated suddenly. Besides, since the discharge flow control means is located in series with the switching means, the hydraulic actuator can be accurately braked and stopped by operating the switching means even in the event of failure of the discharge flow control means, and thus the operability can be improved.

Moreover, since a discharge-side valve and a feed-side valve in the actuator are controlled each independently, the vibration damping effect can be improved. Further, since there is not used a bypass passage for communication between hydraulic fluid feed- and discharge-side pipes, the problem of decrease in the flow rate and speed of fluid fed to the actuator is remedied.

Embodiments of the control system for a hydraulic working machine according to the present invention are not limited to the above embodiments, but various design changes may be made insofar as they fall under the technical concept described in the scope of protection of claims.

Figure 10:
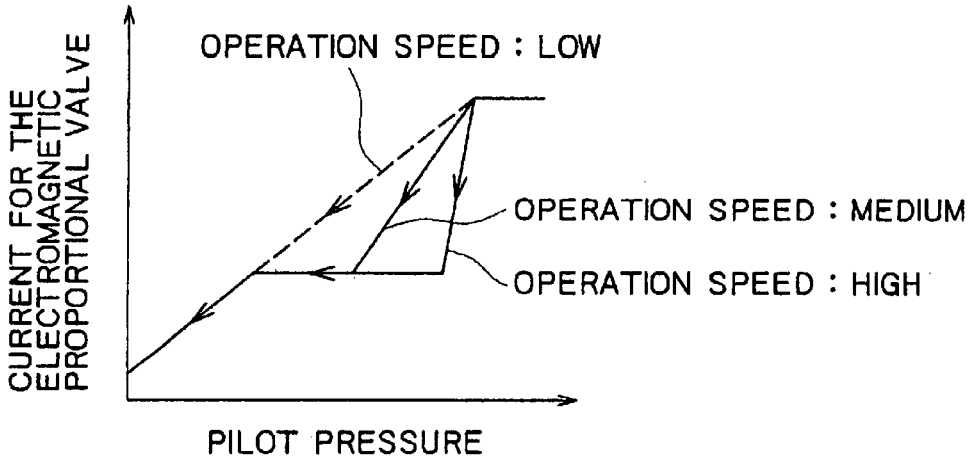
FIG. 10 is a diagram showing a modified example of a relation between a pilot pressure and an electric current applied to the electromagnetic proportional valve.

For example, in the above embodiments, when the operation speed is high, a curvature is provided to change the current for the electromagnetic proportional valve, wherein the current changes according to the degree of curve or a radius of the curvature, as shown in the graph of FIG. 4 which illustrates an electromagnetic proportional valve current vs. a pilot pressure. However, as shown in FIG. 10, the current for the electromagnetic proportional valve may be changed linearly according to operation speeds. Also in this case there will be obtained the same effects as in the above embodiments.

In the above second embodiment, the regenerative pipe line 14 is disposed or located between the first pipe line 15 extending to the head-side oil chamber 5*a* and the discharge pipe line 15*a*. However, the regenerative pipe line 14 may be disposed between the second pipe line 16 extending to the rod-side oil chamber 5*b* and the discharge pipe line 15*a*.

Further, although in the above embodiments the operation speed is calculated using the pilot pressure, there may be adopted a method wherein the amount of operation of the remote controlled valve 8 is detected by means of a sensor and the operation speed is calculated on the basis of the detected amount of operation. Alternatively, the operation speed of the remote controlled valve 8 may be detected directly using a speed sensor. Further, the discharge flow control valve 11 or the regenerative flow control valve 20 may be operated directly in accordance with a command signal provided from the controller 13 without using the electromagnetic proportional valve 12.

The present invention is applicable not only to the boom cylinder circuit in the hydraulic excavator described in the above embodiments but also widely to actuator circuits adapted to actuate movable portions of a large inertia.

We claim:

1. A control system for a hydraulic working machine, comprising:

a hydraulic pump;

a hydraulic actuator adapted to be actuated with a driving medium discharged from said hydraulic pump;

a switching means adapted to control supply and discharge of the driving medium for said hydraulic actuator;

an operating means adapted to operate said switching means;

a discharge flow control means located in a discharge-side pipe line of said switching means, said discharge flow control means controlling a discharge flow rate of the driving medium; and a controller adapted to detect an operation speed of said operating means and operate said discharge flow control means in accordance with the operation speed to be detected, wherein said controller controls opening of said discharge flow control means so as to decrease the discharge flow rate in said discharge-side pipe line when the operation speed of said operating means is high.

2. The control system for a hydraulic working machine according to claim 1, wherein said switching means has a hydraulic pilot switching valve.

3. The control system for a hydraulic working machine according to claim 1, wherein said operating means has a remote controlled valve for a supply of a pilot pressure to said switching means through a pilot line.

4. The control system for a hydraulic working machine according to claim 1, wherein said discharge flow control means has a discharge flow control valve adapted to control the discharge flow rate through an electromagnetic proportional valve.

5. The control system for a hydraulic working machine according to claim 3, wherein said controller comprises a pilot pressure detector adapted to detect the pilot pressure, an operation speed calculating means for calculating an operation speed from changes in a speed of the pilot pressure, an electromagnetic proportional valve current calculating means for calculating a current applied to an electromagnetic proportional valve in accordance with the operation speed calculated, and a command unit adapted to output a command signal based on said current to said electromagnetic proportional valve.

6. The control system for a hydraulic working machine according to claim 1, wherein said discharge flow control means is a regenerative flow control valve provided with a regenerative pipe adapted to supply the driving medium discharged from said discharge-side pipe line to either a first pipe line connected to a head-side oil chamber in said hydraulic actuator or a second pipe line connected to a rod-side oil chamber in said hydraulic actuator.

* * * * *